US007000817B1

(12) United States Patent
Wang

(10) Patent No.: US 7,000,817 B1
(45) Date of Patent: Feb. 21, 2006

(54) NAILING GUN APPLICABLE TO OBLIQUE ROWED NAILS OF DIFFERENT SPECIFICATIONS

(75) Inventor: Brian Wang, Fenyuan Shiang (TW)

(73) Assignee: Bently Fastening Tools Co., Ltd., Taichung (TW)

( * ) Notice: Subject to any disclaimer, the term of this patent is extended or adjusted under 35 U.S.C. 154(b) by 0 days.

(21) Appl. No.: 11/024,654

(22) Filed: Dec. 30, 2004

(51) Int. Cl.
*B25C 1/04* (2006.01)

(52) U.S. Cl. ..... 227/109; 227/119; 227/120; 227/136; 227/148

(58) Field of Classification Search ..... 227/109, 227/120, 148, 119, 136
See application file for complete search history.

(56) References Cited

U.S. PATENT DOCUMENTS 3,007,171 A * 11/1961 Critchley ..... 227/109
4,126,258 A * 11/1978 Martin et al. ..... 227/8
5,579,975 A * 12/1996 Moorman ..... 227/8
5,803,338 A * 9/1998 Singer et al. ..... 227/8
6,431,428 B1 * 8/2002 Chen ..... 227/120
6,779,697 B1 * 8/2004 Lin ..... 227/120
6,880,739 B1 * 4/2005 Zhu ..... 227/109

* cited by examiner

*Primary Examiner*—Scott A. Smith
(74) *Attorney, Agent, or Firm*—Troxell Law Office, PLLC

(57) ABSTRACT

A nailing gun applicable to oblique rowed nails of different specifications includes a nail box having its upper rear side pivotally combined with the head end of a muzzle to form a pivot and its intermediate portion combined with the arc-shaped guiding slot of the combining member of a handle. Thus, the nail box can be adjusted and positioned at a proper angle for loading oblique rowed nails of different specifications. The nail box has a U-shaped nail-guiding plate fitted in a nail head groove and having its upper end formed with an extending section extending upward and reaching the rear end wall of the muzzle. The extending section of the nail-guiding plate is able to guide oblique rowed nails to smoothly move in the interior of the muzzle whenever the nail box is adjusted at a slant angle for loading oblique rowed nails of different specifications.

5 Claims, 7 Drawing Sheets

NAILING GUN APPLICABLE TO OBLIQUE ROWED NAILS OF DIFFERENT SPECIFICATIONS

BACKGROUND OF THE INVENTION

1. Field of the Invention

This invention relates to a nailing gun applicable to oblique rowed nails of different specifications, able to elevate effect in use and lower cost for spare parts.

2. Description of the Prior Art

Generally, the oblique nail box of a conventional nailing gun has an upper intermediate portion and a lower inner portion respectively screwed with the muzzle and the handle of a nailing gun and positioned at a proper slant angle. Thus, the oblique rowed nails loaded in the nail box can be orderly guided to move in the interior of the muzzle to be struck through the nail head groove and the rear end wall surface of the nail guiding inlet of the muzzle.

However, the combination angle of the muzzle and the nail box of the conventional nailing gun is fixed and unchangeable; therefore, each set of muzzle and nail box is only applicable to oblique rowed nails of a single specification. The oblique rowed nails employed nowadays are generally separated into four different slant angles of 17°, 21°, 28° and 24°. Under the circumstances, when oblique rowed nails of different specifications are to be used, different-typed muzzles and nail boxes have to be provided. For instance, if oblique rowed nails with a slant angle of 17° are to be used, a nail box and a muzzle with a slant angle of 17° have to be provided, not only increasing cost in spare parts but also possible to lose or damage the spare parts during disassembling or storing. In addition, if the muzzle and the nail box are not closely and accurately combined together, there will produce a gap between the nail box and the nail guiding inlet of the muzzle, and the rear end wall surface of the nail guiding inlet of the muzzle and the nail head groove of the nail box fail to be connected straight and evenly. Thus, when the oblique rowed nails are pushed to reach the rear end wall surface of the nail guiding inlet along the nail head groove of the nail box, the oblique nails are unable to slide forward smoothly and may be deadlocked.

SUMMARY OF THE INVENTION

The objective of the invention is to offer a nailing gun applicable to oblique rowed nails of different specifications, including a nail box having its upper rear side pivotally combined with the head end of a muzzle to form a pivot and its intermediate portion combined with the arc-shaped guiding slot of the combining member of a handle. Thus, the nail box can be adjusted to a proper slant position for receiving oblique rowed nails of different specifications. The nail box has a U-shaped nail-guiding plate fitted in its nail head groove and having its upper end formed with an extending section extending upward and reaching the rear end wall of a muzzle. The extending section at the upper end of the nail-guiding plate is able to guide oblique rowed nails to smoothly move in the interior of the muzzle whenever the nail box is adjusted and positioned at a proper slant angle for loading oblique rowed nails of different specifications, able to elevate effect in use and lower cost for spare parts.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
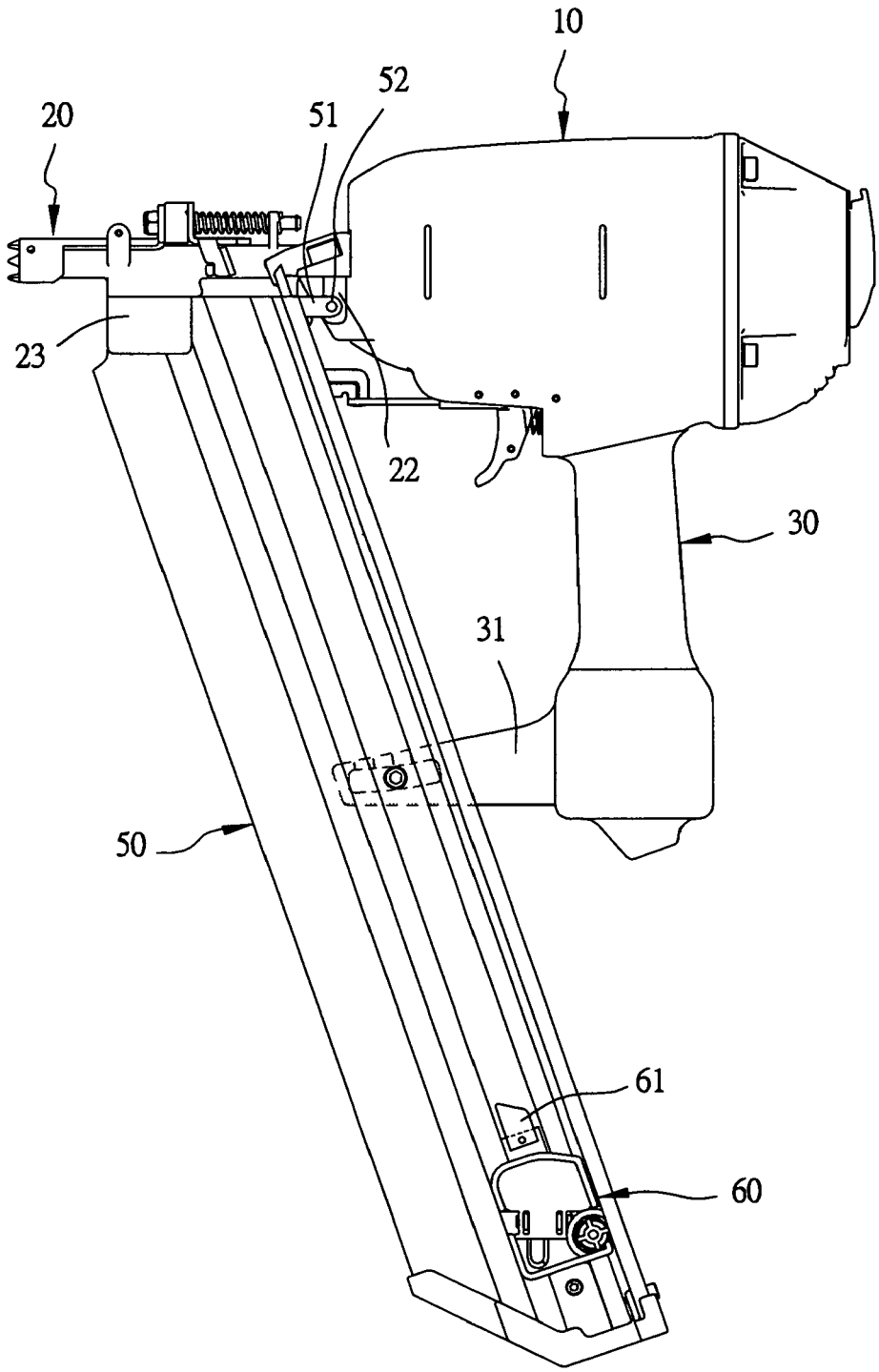
FIG. 1 is a perspective view of a nailing gun in the present invention.
Figure 2:
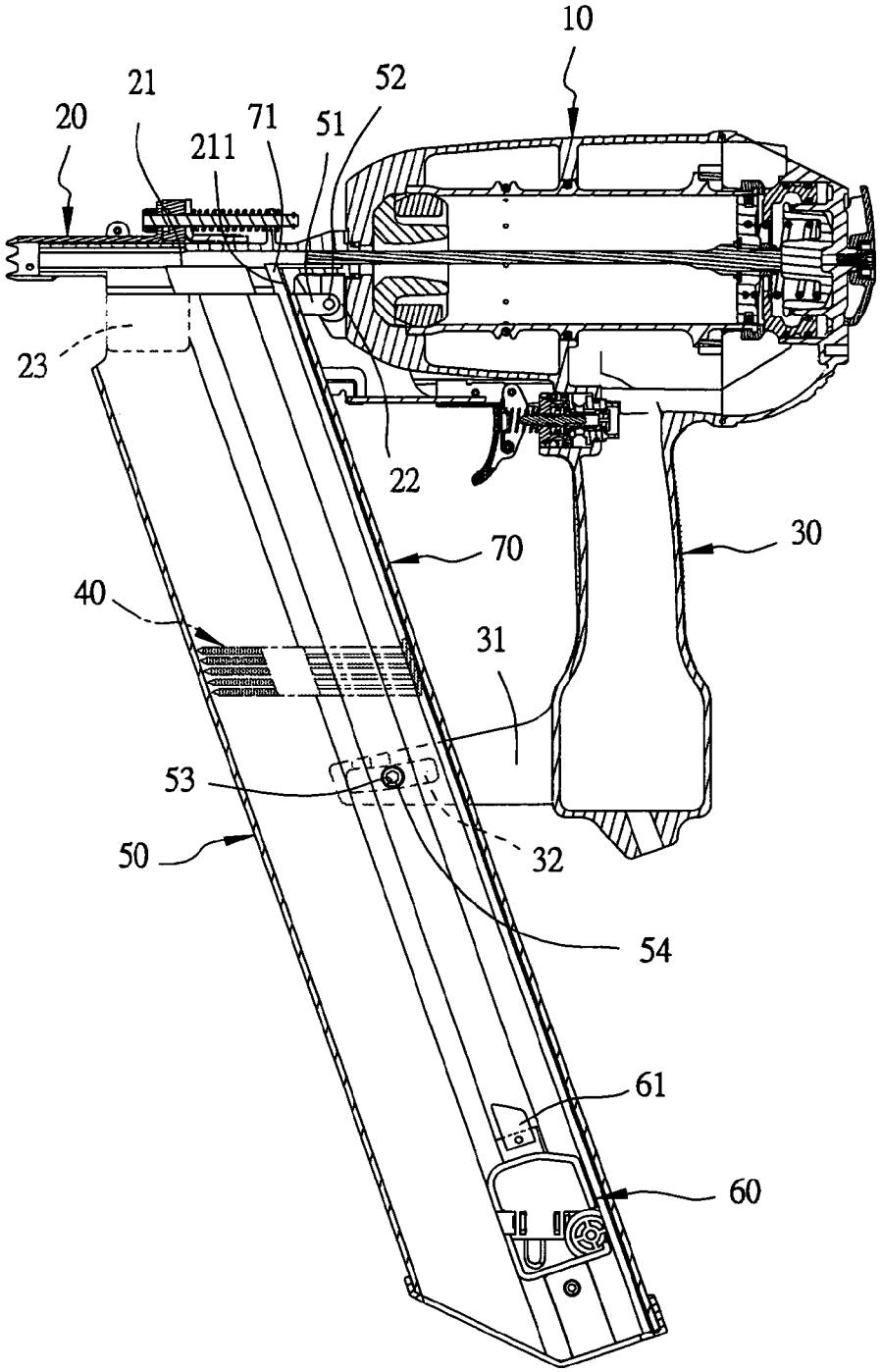
FIG. 2 is a side cross-sectional view of the nailing gun in the present invention.

A preferred embodiment of a nailing gun applicable to oblique rowed nails of different specifications in the present invention, as shown in FIGS. 1 and 2, includes a gun body 10 having its front end extending forward and forming a muzzle 20 having a nail guiding inlet 21 bored in the underside. The gun body 10 has its underside extending downward and forming a handle 30 provided with a transverse combining member 31 at a lower end. A nail box 50 for loading oblique rowed nails therein is disposed between the nail guiding inlet 21 of the muzzle 20 and the combining member 31 of the handle 30. A nail-pushing member 60 is provided in the nail box 50 for pushing the oblique nails 40 to move in the interior of the muzzle 20 through the nail guiding inlet 21 to be struck.

The muzzle 20 is provided with a pivotal portion 22 extending downward from a proper location of its underside and two position-limiting plates 23 of a proper length extending downward from its underside near an upper front portion of the nail box 50. The two position-limiting plates 23 are long enough to receive the top end of the nail box 50 therebetween, no matter what deflection position the nail box 50 may be in. In addition, the rear end wall surface 211 of the nail guiding inlet 21 of the muzzle 20 slants downward and backward for a preset angle.

Figure 3:
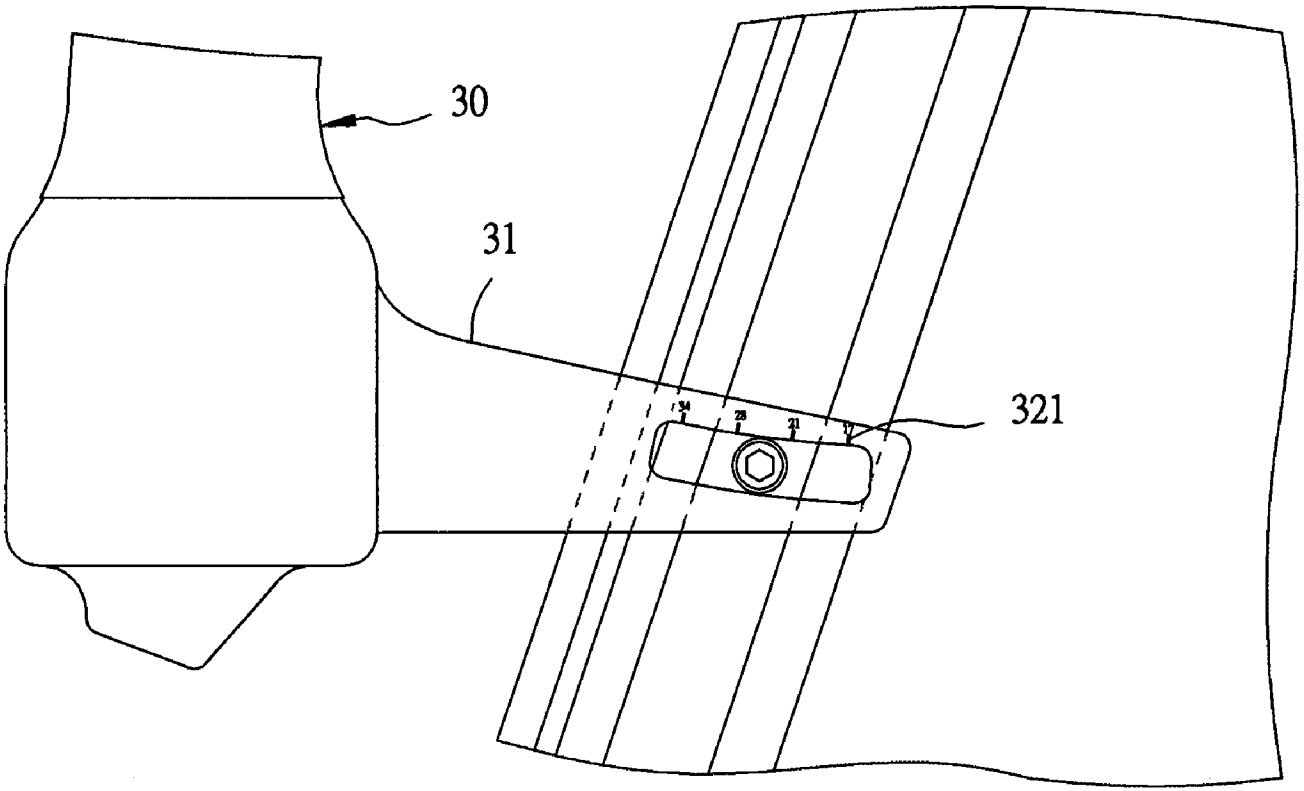
FIG. 3 is a partial side sectional view of the handle of the nailing gun in the present invention.

The handle 30, as shown in FIG. 3, has its combining member 31 bored at a proper location with an arc-shaped guiding slot 32 having its peripheral side marked with graduations 321 at proper locations for indicating slanting angles of the nail box 50.

Figure 4:
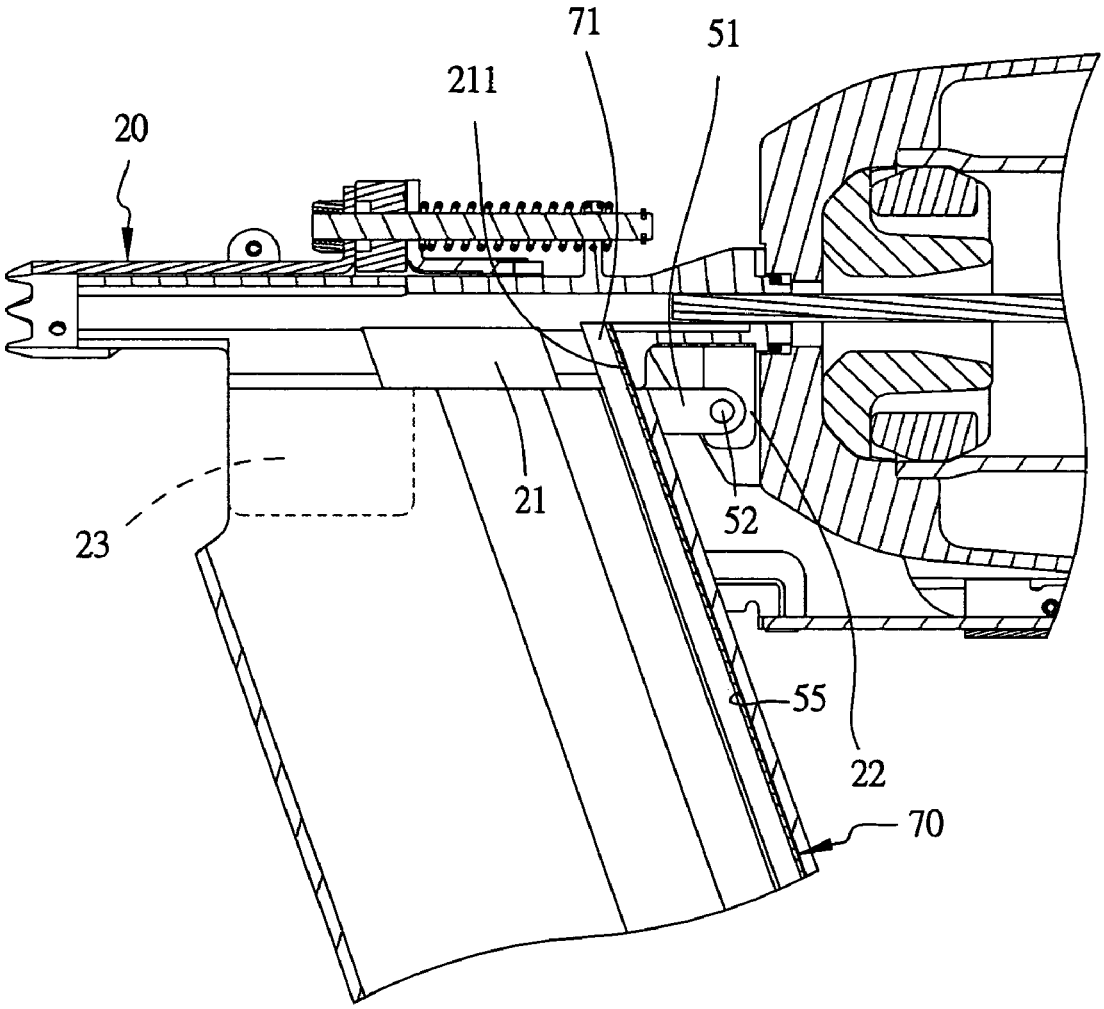
FIG. 4 is a side cross-sectional view of the combination portion of the muzzle and the nail box of the nailing gun in the present invention.

The nail box 50, as shown in FIGS. 2 and 4, has its upper rear side provided at a proper location with two transverse symmetrical lugs 51 positioned at the opposite sides of the pivotal combining portion 22 of the muzzle 20 and pivotally combined with the pivotal combining portion 22 by a pivot 52. Further, the nail box 50 is bored with an insert hole 53 aligned to the arc-shaped guiding slot 32 of the handle 30, with a locking bolt 54 inserted through the insert hole 53 and the arc-shaped guiding slot 32 to combine the nail box 50 together with the handle 30. Thus, by loosening or tightening the locking bolt 54 and with the upper pivotal portion acting as a pivot and restricted to slide in the arc-shaped guiding slot 32 of the handle 30, the nail box 50 can be adjusted and positioned at a proper slant angle according to the four graduations 321 at the peripheral side of the arc-shaped guiding slot 32. The graduations 321 provided in this preferred embodiment include 17°, 21°, 28° and 34°.

Figure 7:
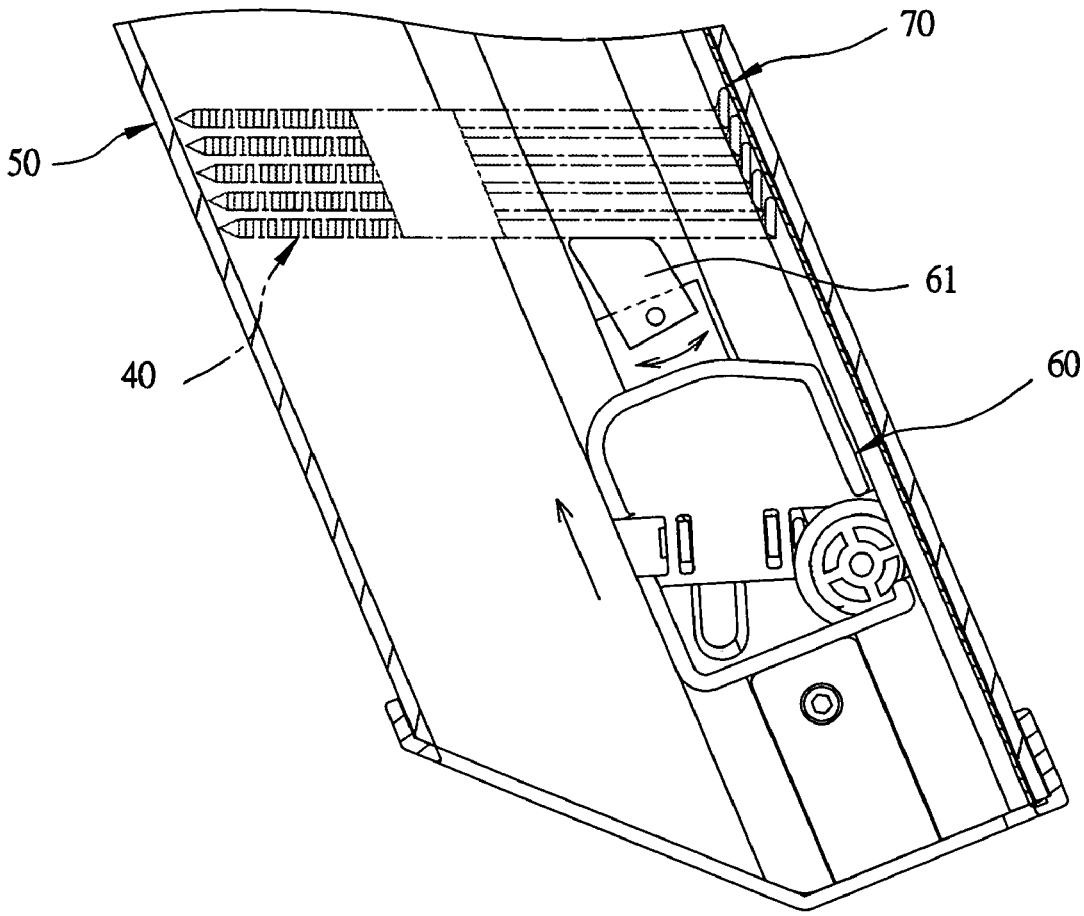
FIG. 7 is a side cross-sectional view of the pushing-and-resisting block in the nail box of the nailing gun in an automatically deflecting and adjusting condition in the present invention.

The nail-pushing member 60, as shown in FIG. 7, has its upper end opposite to the oblique nails 40 pivotally provided with a rotatable pushing-and-resisting block 61 able to automatically adjust itself to closely and evenly push and resist the corresponding side of the oblique nails 40.

A nail-guiding plate 70 with a U-shaped cross section is tightly fitted in the nail head groove 55 of the nail box 50 for the heads of the oblique nails 40 to rest thereon and be guided to slide therein. The nail-guiding plate 70 has its upper end formed with an extending section 71 extending upward and reaching the rear end wall surface 211 of the nail guiding inlet 21 of the muzzle 20 for guiding the oblique nails 40 to move in the interior of the muzzle 20. The nail-guiding plate 70 has high hardness and great abrasion resistance.

Figure 5:
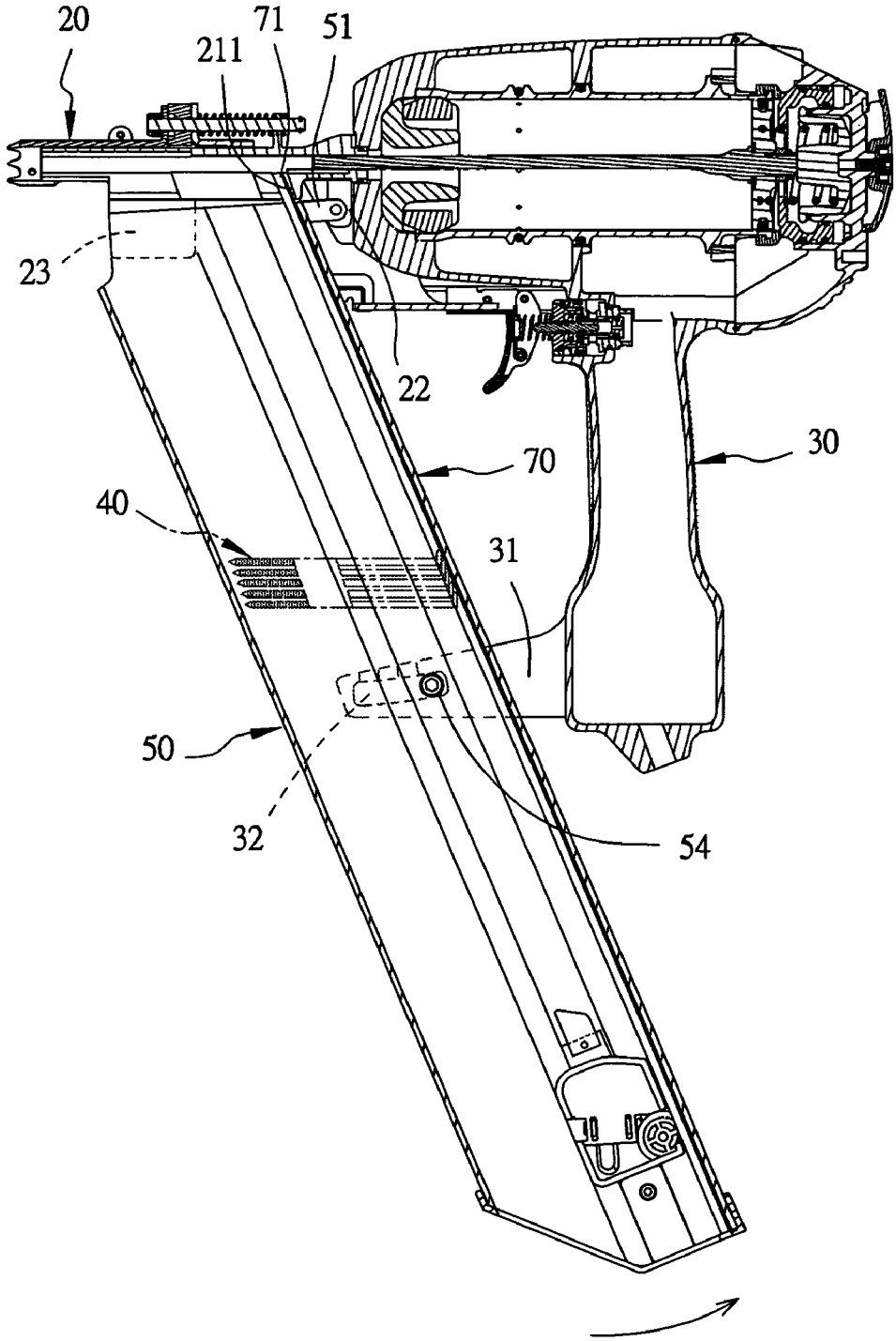
FIG. 5 is a side cross-sectional view of the nail box of the nailing gun in an adjusting and deflecting condition in the present invention.
Figure 6:
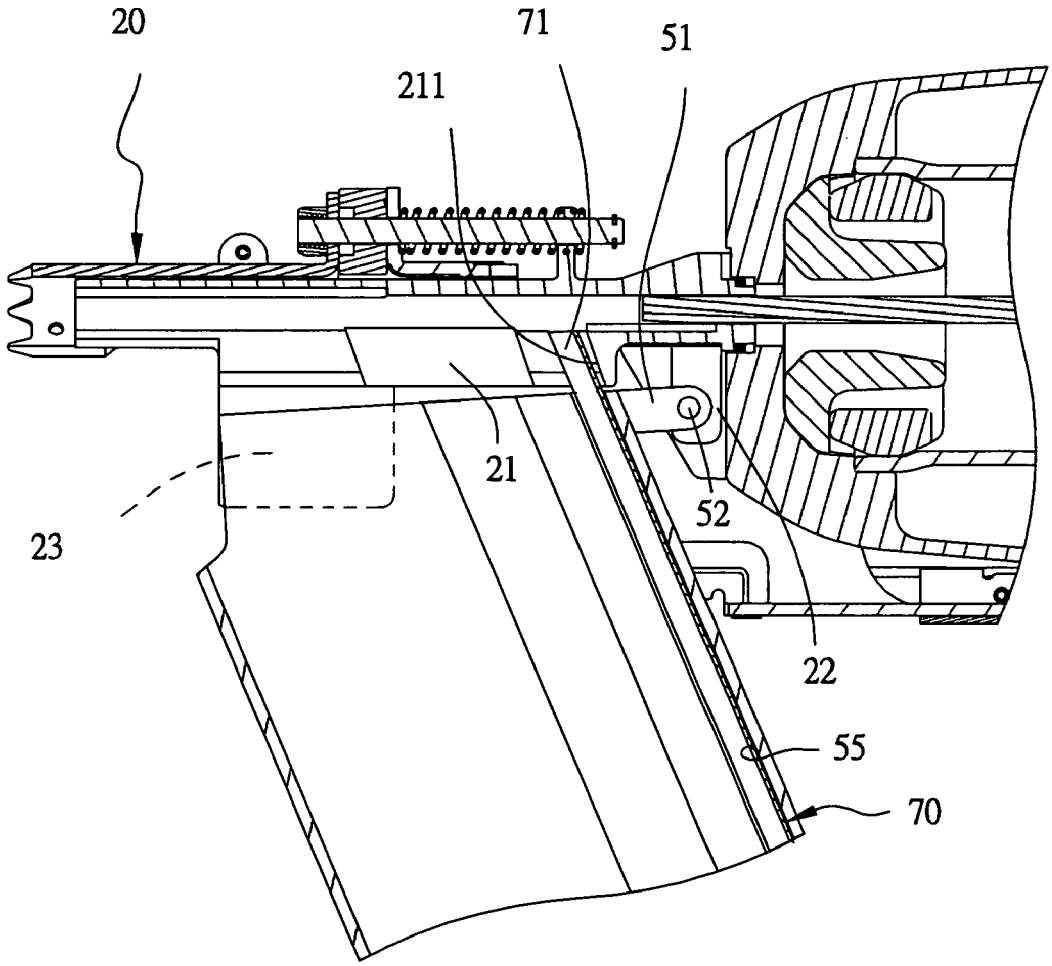
FIG. 6 is a partial magnified side cross-sectional view of the combination portion of muzzle and the nail box of the nailing gun in the present invention.

To adjust the nail box 50 to suit oblique rowed nails 40 of different specifications, as shown in FIGS. 2 and 5, only loosen the locking bolt 54 at the joint of the nail box 50 and the handle 30 and then, according to the specifications of the oblique rowed nails 40 to be used, adjust the nail box 50 to a proper slant angle, with the upper pivotal portion acting as a rotating fulcrum and guided to shift in the arc-shaped guiding slot 32 according to the graduations 321 on the peripheral side of the arc-shaped guiding slot 32. Subsequently, the locking bolt 54 is screwed tight to finish adjusting and positioning the nail box 50 at a required slant position. In an adjusting process of the nail box 50, as shown in FIG. 6, the extending section 71 at the upper end of the nail-guiding plate 70 of the nail box 50 will shift biasly together with the nail head groove 55 of the nail box 50; therefore, the nail guiding angle of the extending section 71 and the nail head groove 55 become the same. In addition, since the rear end wall surface 211 of the nail guiding inlet 21 is slant at a certain angle; therefore, when the nail box 50 is adjusted and positioned at a smallest slant angle, the extending section 71 of the nail-guiding plate 70 can rest against the rear end wall surface 211 without causing interference. Thus, no matter what slant position the nail box 50 may be in, the oblique nails 40 can be smoothly guided by the extending section 71 of the nail-guiding plate 70 to move in the interior of the muzzle 20 to be struck, able to prevent nails from being deadlocked.

To sum up, this invention has the following advantages.

1. The nail box 50 of this invention can be freely adjusted and positioned at a proper slant angle to match with oblique rowed nails 40 of different specifications, and the extending section 71 of the nail-guiding plate 70 of the nail box 50 can always be kept at the location of the rear end wall surface 21 of the nail-guiding inlet of the muzzle 20 for guiding the oblique nails 40 to smoothly move in the interior of the muzzle 20. Therefore, a single nail box 50 can be applied for loading oblique nails 40 of different specifications, greatly elevating effect in use and lowering cost for spare parts.

2. The freely rotatable pushing-and-resisting block 61 pivotally provided at the upper end of the nail-pushing member 60 is able to automatically adjust itself in deflection in accordance with the slant angle of the oblique nails 40 so as to evenly push and resist the corresponding sides of oblique nails 40.

3. The muzzle 20 is provided with two position-limiting plates 23 of a proper length extending downward from the underside; therefore, when the nail box 50 is adjusted and positioned at a comparatively large slant angle, the top end of the nail box 50 can be received and positioned between the two position-limiting plates 23, able to avoid producing a gap.

While the preferred embodiment of the invention has been described above, it will be recognized and understood that various modifications may be made therein and the appended claims are intended to cover all such modifications that may fall within the spirit and scope of the invention.

I claim:

1. A nailing gun applicable to oblique rowed nails of different specifications comprising: a gun body, said gun body having a front end extending forward and forming a muzzle, said muzzle having a nail guiding inlet located on an underside thereof, said gun body having a handle extending downward from a bottom, a nail box disposed between said nail guiding inlet of said muzzle and said handle for loading oblique rowed nails therein, a nail pushing member provided in said nail box for pushing said oblique rowed nails to move in the interior of said muzzle through said nail guiding inlet;

said handle is provided with a transverse combining member at a lower end thereof, said transverse combining member is bored with an arc-shaped guiding slot for pivotally connecting said nail box thereof;

said nail box having a preset portion located on an upper rear side and pivotally combined with said muzzle, said nail box is bored with an insert hole connected with said arch-shaped guiding slot of said handle by a locking bolt, said locking bolt is selectively loosened and tightened to adjust said nail box, an upper pivotal portion serving as a pivot, said locking bolt is slidably located in said arc-shaped guiding slot of said handle, said nail box able to be adjusted and positioned at a predetermined slant angle for facilitating loading of oblique rowed nails of different specifications; and a U-shaped nail-guiding plate fitted in a nail head groove of said nail box, said nail-guiding plate having an upper end located opposite to said muzzle and formed with an extending section, said extending section extending upward and reaching to a rear end wall surface of said nail guiding inlet of said muzzle, said extending section of said nail-guiding plate smoothly guiding said oblique rowed nails to move in the interior of said muzzle when said nail box is adjusted and positioned at a plurality of angles.

2. The nailing gun applicable to oblique rowed nails of different specifications as claimed in claim 1, wherein said muzzle having two position-limiting plates located on a portion of the underside adjacent the upper front side of said nail box and being preset in length and extending downward, and said two position-limiting plates are long enough to receive and position the upper end of said nail box therebetween, when the nail box is selectively adjusted between a plurality of positions.

3. The nailing gun applicable to oblique rowed nails of different specifications as claimed in claim 1, wherein said muzzle is formed with a pivotal device located on the underside of a head, and said nail box is provided with two symmetrical pivotal lugs at an upper rear side, said muzzle and said nail box are pivotally combined together by said pivotal device and said two pivotal lugs.

4. The nailing gun applicable to oblique rowed nails of different specifications as claimed in claim 1, wherein said rear end wall surface of said nail guiding inlet of said muzzle slants downward and backward at a preset angle, and a rear side of said extending section at an upper end of said nail-guiding plate selectively engaging said rear end wall surface of said nail-guiding inlet.

5. The nailing gun applicable to oblique rowed nails of different specifications as claimed in claim 1, wherein said nail-pushing member in said nail box has an upper end pivotally provided with a pushing-and-resisting block able to pivot freely, said pushing-and-resisting block automatically adjusting a position thereof to closely and evenly push and resist said oblique rowed nails.

* * * * *